United States Patent [19]

Wolfelsperger et al.

[11] 4,212,213

[45] Jul. 15, 1980

[54] WEB SEVERING DEVICE AND PROCESS FOR SEVERING A WEB

[75] Inventors: Robert O. Wolfelsperger, Fairfield; William R. Pasco, Brick Town, both of N.J.

[73] Assignee: American Can Company, Greenwich, Conn.

[21] Appl. No.: 950,241

[22] Filed: Oct. 10, 1978

[51] Int. Cl.[2] ..... B26D 7/02

[52] U.S. Cl. ..... 83/56; 83/155; 83/157; 83/418; 83/455; 83/614

[58] Field of Search ..... 83/455, 614, 155, 56, 83/557, 157, 487, 485, 567, 456, 418, 206, 279, 280, 250, 251

[56] References Cited

U.S. PATENT DOCUMENTS

| | | | |
|---|---|---|---|
| 1,344,169 | 6/1920 | Buckingham | 83/455 |
| 1,428,420 | 9/1922 | DeMattia | 83/455 X |
| 2,665,757 | 1/1954 | Stevens et al. | 83/455 X |
| 2,873,802 | 2/1959 | Frohlich et al. | 83/614 X |
| 3,246,551 | 4/1966 | George | 83/155 |
| 3,820,233 | 6/1974 | Baker | 83/455 X |

*Primary Examiner*—Frank T. Yost

*Attorney, Agent, or Firm*—Robert P. Auber; Ira S. Dorman; Stuart S. Bowie

[57] ABSTRACT

A web severing device which includes a web transport means and a web lifting means so that a transported web is lifted away from the surface of the transport means for severing by a cutting means, thus, preventing damage which would occur on contact between the transport means and the cutting means.

5 Claims, 4 Drawing Figures

FIG. 2a
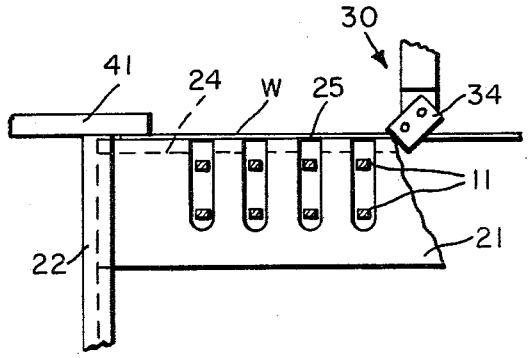
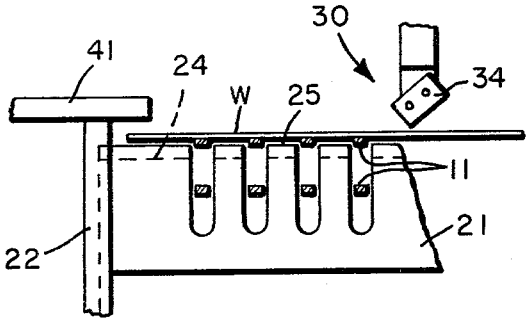
FIG. 2b
FIG. 3
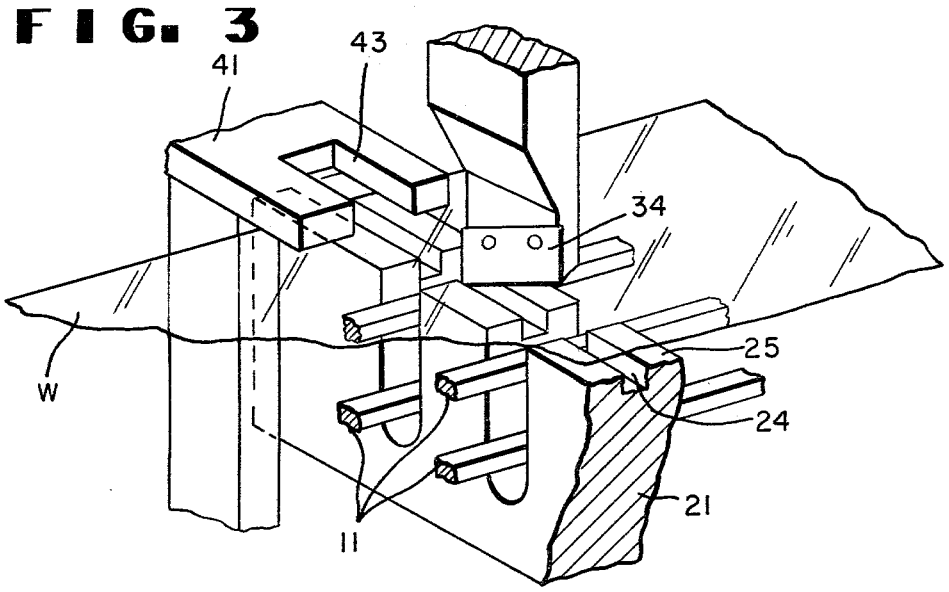

WEB SEVERING DEVICE AND PROCESS FOR SEVERING A WEB

DESCRIPTION

TECHNICAL FIELD

This invention relates to severing devices for webs of indefinite length and it is most directly related to devices for severing webs of packaging material when used in conjunction with package-making devices.

BACKGROUND ART

U.S. Pat. No. 2,665,757 discloses a severing device for cutting definite lengths of rubber and cord to fashion tires from a laminate of the materials. The device utilizes a pair of knives mounted to pierce a tire-building laminate and tear the laminate in opposite directions following the line of the tire cord in the laminate.

U.S. Pat. No. 4,030,388 discloses a device for severing thermoplastic film webs in the manufacture of vacuum skin packages. That device includes a chain-driven pair of knives which cooperate to make initial and final cuts to sever a web. The web to be severed is not moved out of its plane of transport prior to severing and must not have elements of support or transport in the path of severing.

SUMMARY OF THE INVENTION

According to this invention, there is provided a web severing device which includes a web transporting means, a web lifting means, and a web cutting means. The web lifting means is located to move a web to be severed apart and away from the web transporting means and to make the web taut for meeting the web cutting means. The web lifting means permits severing a web without damage to the web transporting means.

Additionally, there is provided a web edge clamping means which causes the edge of the web to be severed to be held between the clamping means and the top or lifting edge of the lifting means when the lifting means is in the lifting mode. The clamping means is mounted in a relation to the lifting means to interfere with and contact the lifting edge such that the edge of the web is firmly held.

DESCRIPTION OF THE DRAWINGS

FIG. 2*a* is a cutaway view of elements of the device wherein the web lifting means is in the normal or unsupporting mode.

FIG. 2*b* is a cutaway view of elements of the device wherein the web lifting means is in the lifting mode.

FIG. 3 is an enlarged cutaway view of the cooperation among web transporting, lifting, clamping, and cutting means.

In FIG. 1, web transport means 10 is represented by a plurality of endless belts 11 positioned to provide a planar transport surface and carried on pulleys 12 and 13 supported by bars 14 and 15. Either of bars 14 and 15 can be driven to provide power to the belts 11 for web transport.

Figure 1:
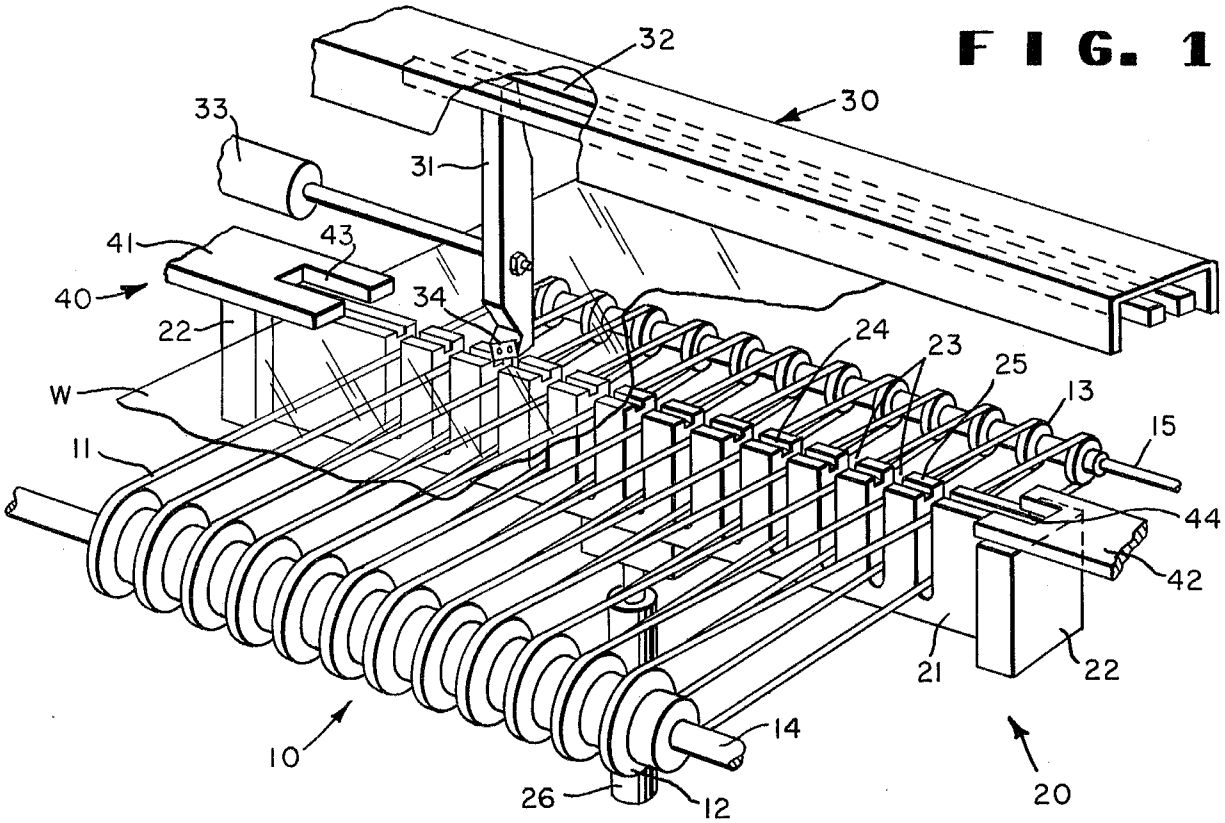
FIG. 1 is a representation, in simplified and cutaway form, of the severing device of this invention.

Web lifting means 20 is represented by web lifter 21 slidably positioned in web lifter guides 22 to move in a direction generally perpendicular with the planer transport surface. The web lifter 21 includes a plurality of notches 23 of a depth to contain belts 11 and also includes a groove 24 along the length of the lifter 21 and in the edge of the lifter nearest the transport surface. The edge area of web lifter 21 which remains after cutting notches 23 and groove 24, is defined as the lifting edge 25. Lifting edge 25 extends transversely across the planar transport surface at least as far as the extremes of the web material to be severed. The web lifting means usually extends across the transport surface approximately perpendicular with the intended direction of web travel, but the web lifting means can be located at some other angle with the direction of web travel if such is desired or required. The lifting edge is located, in the normal mode, below the transport surface and, in the lifting mode, above the transport surface.

Web cutting means 30 is represented by web cutter 31 slidably mounted in web cutter guide 32. The web cutter 31 is mounted to supportively slide in the cutter guide 32 and blade 34 on the web cutter 31 is positioned to be received by and to operatively slide in groove 24 of the web lifter 21 when the lifter is in the lifting mode.

Web clamping means 40 is represented by fixed clamping plates 41 and 42 positioned above web lifter 21 such that when web lifter 21 is in the lifting mode the edge of any web on the planar transport surface of the web transport means 10 is clamped between the lifter 21 and the clamping plates 41 and 42. The clamping plates 41 and 42 are fitted with slots 43 and 44. Slots 43 and 44 provide access for web cutter 31 to a clamped web edge in operation of the device. Web cutter 31 generally has a parked location in slot 43 beyond the expected edge of any web to be transported.

In operation, again referring to FIG. 1, a web W (shown here in partial view, schematic) is introduced to the web transport means 10 and is transported into the severing device. Webs severed by means of the present device are generally of indefinite length and are severed as one step in some associated process, such as in a packaging process. The web to be severed is transported on the planar transport surface until the intended severing point is directly over the groove 24 in web lifter 21. Travel of the web is stopped; the web lifter is raised from the normal mode to the lifting mode, such as by a fluid-driven cylinder 26, thus lifting the web apart and away from the transport surface; the edge of the web is held between the lifting edge 25 and the clamping plates 41 and 42; the web cutter 31 is moved, from its parking place in slot 43, along the groove 24 in raised web lifter 21, severing the web from the clamped edge to the opposite edge.

While the web could be severed without the clamping element of this invention, it is preferred that lifting the web by web lifting means 20 should also be accompanied by clamping the web at at least one edge. Such clamping provides a taut edge at which to commence the cut. The cycle of operation is completed when the web lifter is returned to its normal mode, the web cutter is returned to its parking place, and the severed web is transported away. The web cutter 31 can be moved through the cutting and returning operations manually or by means of mechanical devices or pneumatic or hydraulic cylinders, automatically or manually controlled. Fluid-driven cylinder 33 is shown in FIG. 1 for operating web cutter 31.

FIGS. 2*a* and 2*b* provide more detailed understanding of the cooperation among web transport means, web lifting means, web cutting means, and web clamping means. FIG. 2*a* depicts the web severing device with the web lifter 21 of its web lifting means in the normal mode. In that mode, endless belts 11 (seen here in sectioned end view) provide a planar transport surface for the web W. The surface and the web W are beneath the blade 34 of web cutting means 30 (shown here midway in its return operation) and are beneath the clamping plate 41 (shown here fixed to a web lifter guide 22). Blade 34 is above groove 24 in, this, the normal mode. FIG. 2*b* depicts the web severing device with the web lifter 21 of its web lifting means in the lifting mode. In that mode, lifting edge 25 of web lifter 21 is raised above the planar transport surface of the endless belts 11 and, thus raises web W to be held secure by clamping plate 41 between the clamping plate 41 and the lifting edge 25 and to be placed in the cutting path of blade 34 on web cutting means 30 (shown here midway in its cutting operation). Blade 34 is in groove 24 in, this, the lifting mode.

In a more detailed representation of the web severing device, FIG. 3 depicts a sectioned portion of the device with web lifter 21 in the lifting mode holding web W between web lifter 21 and clamping plate 41, above endless belts 11, and taut over groove 24 in the path of blade 34.

Best Mode and Industrial Applicability

The severing device of this invention is useful to sever a wide variety of web materials including paper, plastic film, and metal foils, and it is presently contemplated for use in packaging devices wherein severed sections of thermoplastic film are used in manufacture of heat-sealed packages. Specifically, the severing device of this invention is contemplated for use in conjunction with a vacuum skin packaging device such as that disclosed and claimed in U.S. Pat. No. 4,077,184. The film most often used in such packaging operations is made from an ionomeric copolymer of polyethylene and an ethylenically unsaturated carboxylic acid.

We claim:

1. A web severing device comprising webtransporting means, web lifting means located to move a web to be severed apart and away from the web transporting means, web cutting means to sever the web without damage to the web transporting means, and web clamping means mounted to interfere with and contact an end of the lifting edge in the lifting mode, said web transporting means having a planar web transport surface, and said web lifting means having a lifting edge which, in a normal mode, is located below the web transport surface and, in a lifting mode, is located above the web transport surface.

2. A web severing device comprising web transporting means, web lifting means located to move a web to be severed apart and away from the web transporting means, and web cutting means to sever the web without damage to the web transporting means, wherein: the web transporting means has a planar web transport surface; the web lifting means has a lifting edge which, in a normal mode, is located below the web transport surface and, in a lifting mode, is located above the web transport surface; the web cutting means includes a blade and is slidably mounted with respect to the web lifting means; and wherein the lifting edge has a groove along the length of the web lifting means which, in a lifting mode, receives the blade such that the blade is in the groove along the length of the lifting means.

3. The web severing device of claim 2 wherein there is, additionally, a web clamping means mounted to interfere with and contact an end of the lifting edge in the lifting mode.

4. A web severing device comprising web transporting means, web lifting means located to move a web to be severed apart and away from the web transporting means, and web cutting means to sever the web without damage to the web transporting means, wherein: the web transporting means includes a plurality of substantially parallel and spaced apart endless belts positioned to provide a planar web transport surface; and wherein the web lifting means is positioned transverse to the direction of the endless belts, has a plurality of notches of a depth to contain the belts, and has a lifting edge which, in a normal mode, is located below the web transport surface, and, in a lifting mode, is located above the web transport surface.

5. A process for severing a web comprising the steps of transporting a web to be severed on a planar transport surface to a web severing location;

lifting the web apart and away from the planar transport surface by clamping the web at one edge; and cutting the web by drawing a blade transversely across the lifted web, starting at the clamped edge.

* * * * *